United States Patent [19]

Le Tarte

[11] Patent Number: 4,576,674

[45] Date of Patent: Mar. 18, 1986

[54] MASKING TAPE DISPENSER

[76] Inventor: Walter Le Tarte, P.O. Box 68, Smiths Creek, Mich. 48074

[21] Appl. No.: 621,545

[22] Filed: Jun. 18, 1984

[51] Int. Cl.[4] ..... B31F 1/00

[52] U.S. Cl. ..... 156/463; 156/465; 156/510; 225/77; 493/439; 493/440; 493/443

[58] Field of Search ..... 156/201, 461, 463, 465, 156/510, 523, 527, 577; 493/439, 440, 443; 225/42, 46, 56, 77

[56] References Cited

U.S. PATENT DOCUMENTS

| | | | |
|---|---|---|---|
| 878,829 | 2/1908 | Roesen | 493/440 |
| 2,309,093 | 1/1943 | Borden | 156/465 |
| 2,581,190 | 1/1952 | Hodges | 225/77 |
| 2,911,214 | 11/1959 | Sherbrook | 493/439 |
| 3,544,107 | 12/1970 | Blomberg | 493/439 |
| 4,274,904 | 6/1981 | Harrison et al. | 156/461 |

*Primary Examiner*—Michael Wityshyn
*Attorney, Agent, or Firm*—Cullen, Sloman, Cantor, Grauer, Scott & Rutherford

[57] ABSTRACT

An edge blending masking tape dispenser has an upright support plate and a base with a tear off edge above the base. A roll of adhesive coated masking tape is journaled and yieldably retained upon the support plate and passes over a tape edge folding and forming die which has a cam surface so as to constrict and upwardly deflect and form the leading one edge portion of the tape. The tape further passes over and around the tape support in tension with the upwardly deflected one edge of the tape folded down upon the adhesive side thereof. This provides a non-stick free floating edge along the tape to permit feathering and blending of new paint with an existing tape finish, when the masking tape is adhered thereto.

6 Claims, 8 Drawing Figures

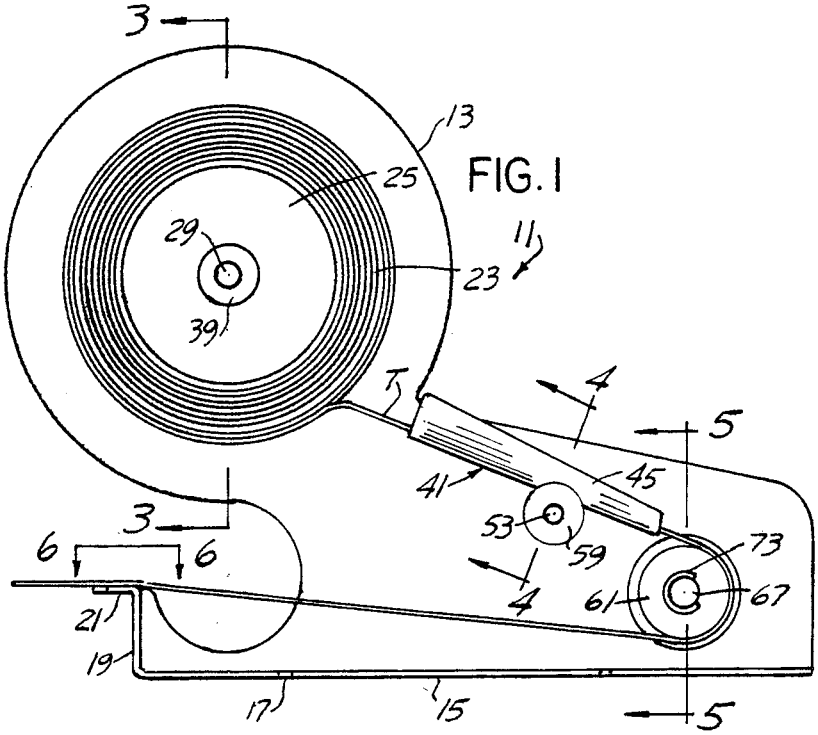
FIG. 1
FIG. 2
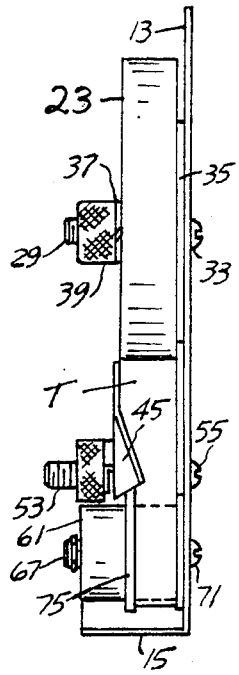
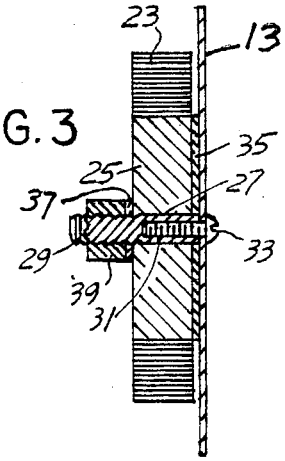
FIG. 3
FIG. 4
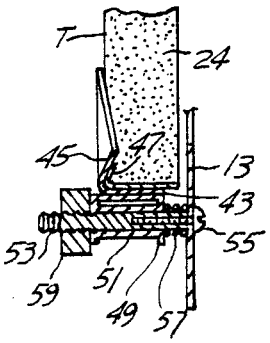
FIG. 5
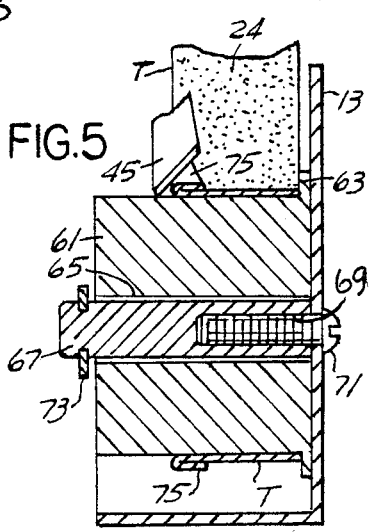
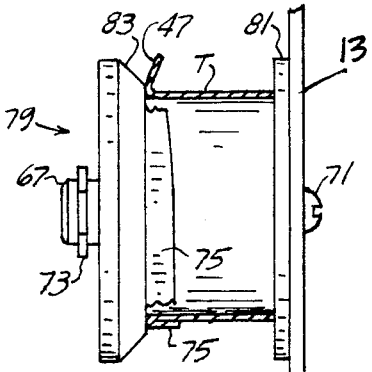
FIG. 7
FIG. 6
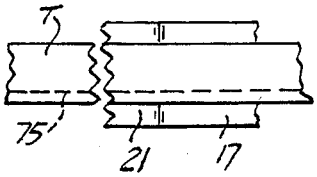
FIG. 8
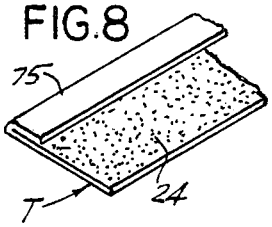

MASKING TAPE DISPENSER

The present invention relates to the dispensing of masking tape and more particularly to an edge blending masking tape dispenser for providing a strip of masking tape having a folded over non-adhesive surface adjacent and along the adhesive surface for the length of the strip dispensed.

BACKGROUND OF THE INVENTION

Masking tape dispensers conventionally included a support for mounting a roll of masking tape and at least one guide roll around which the tape is moved as it is pulled off the tape roll and over a serrated tear edge support. Said masking tape is used in connection with applying paint to existing painted surfaces. Heretofore there has existed the problem of providing a masking tape which will overlie a portion of a body surface previously painted to as to define a line along which the paint may be sprayed or brushed as a continuation of the old finish. The problem has existed in providing feathering of the new paint with the old which is difficult with conventional masking tapes unless in some manner the outer longitudinal edge of the tape may be elevated from the body to which paint is to be applied by spraying or otherwise.

THE PRIOR ART

Illustrations of prior art tape dispensers and tape forming devices are shown in the following U.S. Patents

| NUMBER | NAME | DATE |
|---|---|---|
| 2,916,079 | E. H. Schiefer | December 8, 1959 |
| 2,931,645 | C. B. Gillian | April 5, 1960 |
| 2,956,799 | H. M. Wasson | October 18, 1960 |
| 3,451,204 | C. Cramer et al | June 24, 1969 |
| 3,635,473 | Osamu Sasaki | January 18, 1972 |

SUMMARY OF THE INVENTION

An important feature of the present invention is to provide an improved masking tape dispenser by which upon dispensing of the tape from the tape roll, there will be automatically formed therein along one longitudinal edge a folded over portion for the length of the strip which is non-adhesive.

Another feature to provide an improved edge blending tape dispenser for reducing time and cost of body masking and particularly vehicle bodies while providing a better control of paint finishing and blending with an existing painted surface.

Another feature is to provide an improved edge blending masking tape dispenser adapted to feed a standard one inch masking tape having one adhesive surface and feeding the strip of tape over a special forming roll or die assembly so as to fold up and fold down, for illustration a one-eighth inch strip along one edge of the tape; and wherein the tape as dispensed is ready for immediate masking with a non-stick free floating edge built into the dispensed strip for improved results when feathering and blending new paint into existing paint finishes.

Another feature is to provide an improved masking tape dispenser which incorporates a tape edge forming, folding and forming die assembly over which the tape is manually moved wherein one longitudinal edge of the tape is elevated and folded down onto the adhesive side of the masking tape strip as it passes around the die assembly automatically forming down stream of the die assembly a folded down non-stick strip along one edge of the tape.

An important feature is to provide an improved edge folding and forming roll on the support plate of the dispenser so as to receive the strip of tape as it is moved thereover and wherein, the folding and forming roll is of such constricted shape less than the width of the tape being fed as to automatically fold upwardly a longitudinal one edge portion of the strip as it passes around the roll and wherein the elevated edge is folded down onto the adhesive side of the tape and adhered thereto.

Another feature is to provide an edge folding and forming die assembly which includes within the tape edge folding and forming roll an annular portion of a width less than the width of the tape projected thereover, with a cam or tapered guide means formed upon the roll upon one side so as to operatively engage and cam upwardly one longitudinal edge portion of the tape. As the tape passes around the folding and forming roll under tension the upwardly raised folded edge portion of the strip is folded down onto the underlying adhesive surface and secured thereto.

A further feature is to provide a die assembly which includes a tape edge folding roll which is journaled upon the support plate for supporting the free end of the tape as it passes over and around said roll, and in conjunction therewith and intermediate the roll of tape and the folding roll, an elongated tape edge folding die which has an elongated tape support and along one edge an upright tape guide at its forward end inclined and converging laterally inward for deflecting and folding upwardly one longitudinal edge of the tape.

A further feature includes an improved mounting of the tape roll upon the support plate of the dispenser, and an improved mounting for the edge folding and forming roll thereon.

A further feature includes adjustably mounting of the tape edge folding die with respect to the support plate of the dispenser so that it may be adjustably mounted upon a horizontal axis and at the same time may be adjusted laterally relative to the support plate for regulating the width of the strip to be folded over automatically upon the adhesive strip as it is dispensed manually under tension from the tape roll.

These and other objects and features will be seen from the following Specification and claims in conjunction with the appended drawing.

THE DRAWING

FIG. 1 is a side elevational view of the present edge blending masking tape dispenser.

FIG. 2 is a right end elevational view thereof.

FIG. 3 is a section taken in the direction of arrows 3—3 of FIG. 1.

FIG. 4 is a fragmentary section taken in the direction of arrows 4—4 of FIG. 1.

FIG. 5 is a fragmentary section taken in the direction of arrows 5—5 of FIG. 1.

FIG. 6 is a fragmentary section on an increased scale taken in the direction of arrows 6—6 of FIG. 1.

FIG. 7 is an elevational view of a modified tape folding and forming die assembly journaled upon a support plate fragmentarily shown.

FIG. 8 is a fragmentary perspective view of the edge blending masking tape as dispensed.

It will be understood that the above drawing illustrates merely preferred embodiments of the invention and that other embodiments are contemplated within the scope of the claims hereafter set forth.

DETAILED DESCRIPTION OF AN EMBODIMENT OF THE INVENTION

Referring to drawing, FIGS. 1 through 6 and 8, the present edge blending masking tape dispenser is generally indicated at 11, FIG. 1, and includes a formed upright roll support plate 13 and a right angularly related base plate 15 adapted for mounting upon any support and having a pair of longitudinally spaced apertures 17 to receive fasteners for securing base plate to such support.

Base plate 15 at one end terminates in upright tape support 19 having an outturned serrated tear edge 21 by which the tape dispensed is severed from the tape remaining up to the tape support 19.

Tape roll 23 adhesive coated on one side is conventional or standard masking tape which in the illustrative embodiment is one inch wide, and has a conventional pressure sensitive adhesive coating 24, FIG. 1. The tape roll 23 has a leading tape strip designated at T as it is drawn manually and longitudinally off from the roll 23 for movement and forming through the dispenser. The tape roll 23 is journaled and supported upon a conventional spool 25 which is apertured at 27, FIG. 3, and mounted upon the bolt or stud 29. Said stud at one end is secured to support plate 13 and projects outwardly thereof at right angles and overlies base plate 15.

One end of the stud 29 has a threaded bore 31 adapted to receive a suitable screw fastener 33 securing the stud into the position shown in FIGS. 1, 2 and 3 and with the spool 25 positioned thereon.

In assembly of the spool 25 and masking tape roll 23 upon stud 29 there is first mounted thereon a disc spacer or washer 35, FIG. 2, normally spacing the roll outwardly of support plate 13. Mounted upon said stud is a tension spring 37 and suitable washer, not shown; and a knurled fastener 39 is threaded over said stud and in engagement with tension spring 37.

By this construction the roll of tape 23 and its spool 25 is mountable in an upright position upon support 13 and yieldably retained upon the stud 29 yieldably resisting rotary motion manually as directed longitudinally of the tape T, as it is fed off roll 23.

Tape T, FIG. 1, supportably extends over the tape edge folding die 41 which includes the elongated tape support plate 43. Said tape edge folding die includes upon one longitudinal edge of plate 43 the upright inturned tape edge folder 45. As shown in FIGS. 2, 4 and 5, the upright tape guide 45 extends along the length of its support plate 43 and at its forward end is inclined inwardly and converges toward support plate 13.

As the tape strip T extends over support plate 43, the trailing portion of the tape guide 45 guidably receives the one longitudinal edge of the tape, FIGS. 2, 4 and 5. The tape guide towards its forward end is gradually curved and tapered inwardly so that there is formed therein an obstructing cam surface which is in the path of forward movement of the corresponding edge of the tape so as to cause an upward folding movement of the leading edge of the tape as shown at 47, FIG. 4. Thus, the leading edge of the tape strip T is deflected and folded upwardly as the tape is drawn manually along support 43 of folding die 41.

The present elongated tape edge folding die, sometimes referred to as part of a folding die assembly, is adjustably mounted upon support plate 13 for adjustment upon a horizontal axis for determining the inclination of support plate 43. This provides a convenient inclined support for the tape strip T as it passes over the edge folding die 41 and onto the idle forming roll 61.

The mounting of the tape edge folding die includes a U-shaped stirrup 49, FIG. 4, secured upon the undersurface of plate 43 intermediate its ends, and includes between the sides thereof sleeve 51. The stirrup 47 and sleeve 51 are supportably positioned over stud 53 which at one end is secured to support plate 13. A screw fastener 55 extends through support plate 13 and into a corresponding threaded bore similar to bore 31 in FIG. 3 for anchoring the stud 53 so as to extend rigidly at right angles to support plate 13.

Before assembling the stirrup 49–51 over the stud 53, there is first mounted thereon a compression spring 57, FIG. 4. The knurled nut or other fastener 59 is threaded over the outer end of stud 53 and in operative retaining engagement with stirrup 49 for adjustably anchoring tape edge folding die 41 upon support plate 13.

By loosening the fastener 59, and in view of compression spring 57, the tape edge folding die 41 can be inclined at the desired angle and secured in position. Mounting spring 57 upon stud 53 in conjunction with knurled nut 59 provides a means by which the support plate 43 of the tape edge folding die 41 may be adjusted transversely with respect to support plate 13 of the dispenser. This provides a means for regulating the width of the folded over strip 75 along the forward leading edge of tape T.

Mounted upon support plate 13 adjacent the end away from tape support 19 is an idle tape edge forming roll 61, preferably constructed of a hard plastic material such as Nylon, a trademark, and which is adapted to receive the strip of tape and wherein the leading edge thereof has been folded up and over as at 47, FIG. 4, as said tape strip is passed through the tape edge folding die 41.

The roll 61 has at one end adjacent support plate 13 an annular stop flange 63 adapted to supportably engage one free longitudinal edge of tape T, where said tape is mounted upon and extends around idler forming roll 61.

With one edge of the tape bearing against stop flange 63 on roll 61, forward advancing manually of the tape at its free end causes the leading other edge of the tape to be folded upwardly and inclined inwardly, in FIG. 4. Due to the longitudinal tension upon the tape as it is pulled around roller 61 the bent up longitudinal edge 47, FIG. 4, is further bent downwardly into parallel securing engagement with the adhesive side 24 of the tape, FIG. 5, as the tape moves around idle forming roll 61.

Roll 61 has a bore 65 oversized with respect to and is positioned over stud 67. Said stud at one end bears against and is secured to support plate 13 at right angles thereto, positioned above base plate 15.

One end of stud 67 has a threaded bore 69 adapted to receive the screw fastener 71 for anchoring the stud into position. C-shaped snap ring 73 is removably positioned over the outer end of stud 67 within a corresponding annular slot therein and is adapted to loosely and retainingly engage the outer side of tape edge forming roll 61.

In the illustrative embodiment there is thereby provided at the top of the roll 61 the tape T having folded thereover an elongated edge portion 75 of uniform width, such as one eighth of an inch, for illustration. The edge portion has a non-stick free floating surface as it overlies adhesive surface 24. A portion of the undersurface of the masking tape when applied to a body part is thereby provided with a non-stick free floating edge. Thus the tape T as dispensed has an adhesive surface 24 thereon, FIG. 8, with a fold-down strip 75 overlying one edge portion of the adhesive strip of tape. This provides upon the undersurface of the tape when used, an elongated non-sticking edge ready for immediate masking. The non-stick free floating edge 75 is so positioned upon a vehicle body, for example, and extends inwardly to the previously painted surface so that when spray paint, for example, is applied to the unpainted portion for the body or fender, the paint sprayed is feathered under the loose non-stick edge 75 for blending the new paint into the existing paint finish.

The present edge blending masking tape dispenser is particularly useful for paint shops for better control of paint finishing, edge blending and two tone striping. The present dispenser feeds a standard one-inch masking tape around the forming die assemblies so as to fold over a narrow edge 75 of the tape along one side causing it to adhere to the underside of the tape. As a result the tape is dispensed with a non-stick free floating edge ready for immediate use in body masking.

The free floating tape edge 75 eliminates hard blend lines by feathering paint spray so that the new paint blends smoothly with the old finish with no visible demarkation.

The present edge blending tape as dispensed is also effective for edge blending of two tone finishes, providing a smooth edge line where two colors meet. Striping can be applied to the surface without paint build-up problems. The tape roll over edge 75 is adjustable from one eighth of an inch to one quarter of an inch for illustration.

MODIFICATION

A modified tape folding and forming roll 79 is shown in FIG. 7 constructed of Nylon or other hard plastic. Forming roll 79 has upon one end annular stop flange 81 and upon its opposite side a tapered edge turning annular flange 83.

It is contemplated as a simplification of the present dispenser that instead of employing the edge forming roll 61 of FIG. 1 and the edge folding die 41 therein, both of these will be replaced by the single tape edge folding and forming roll 79 mounted upon stud 67 and retained thereon as by fastener 71 and snap ring 73 as shown in FIG. 1.

The construction of the edge folding and forming roll is such as to provide between the flanges 81 and 83 a channel which is less than the width of tape T so as to provide the folding and camming of one longitudinal edge portion of the tape as at 47, FIG. 7 to a substantially upright and inwardly inclined position.

As the tape T is pulled in tension over and around the edge forming roll 79 the upwardly inclined edge 47 will be further bent downwardly into the adhesive engagement with the body of strip T. This provides an elongated edge blending masking tape, FIG. 8, bent in the same manner as above described with respect to FIG. 1. The leading edge of the tape moves over the tape support 19 and is severed across the serrated tear edge 21.

The tape edge folding and forming roll 79 is used alone and in conjunction with tape roll 23, and without the use of the intermediate tape forming die 41. Roll 79 is effective for providing such constriction of one longitudinal edge of the tape as to fold the tape up and over progressively, FIG. 7, so that as the tape passes around roller 79 it is adhered to the undersurface of the tape.

Having described my invention, reference should now be had to the following claims.

I claim:

1. An edge blending masking tape dispenser comprising an upright roll support plate having a right angular apertured base plate mountable upon a support and having at one end an elevated serrated tape tear off edge;

an upright roll of adhesive coated masking tape journaled and yieldably retained upon said support plate above said base plate;

a tape edge folding and forming die assembly spaced from said tape roll mounted upon said support plate and having a channel of less width than the tape;

the free end of the tape extending to and around said forming die assembly to and over said tear-off edge for longitudinal manual feeding thereof;

said die assembly elevating one longitudinal edge of the tape and folding said edge down onto the tape as it passes around said die assembly, automatically forming downstream of said die assembly a folded down non-stick strip along one edge of said tape;

said die assembly including a tape edge folding and forming roll journaled upon said support plate and having an annular channel of less width than the tape;

the free end of the tape extending to and around said forming roll;

said roll elevating one longitudinal edge of the tape and folding said edge down onto the strip as it passes around said roll.

2. In the tape dispenser of claim 1, the channel in said forming roll defining an annular stop flange adjacent said support plate guidably engaging one longitudinal edge of said tape;

and an annular tapered edge folding flange spaced from said stop flange, operatively engaging the other longitudinal edge of said tape and bending it upwardly for a portion of its width, continued longitudinal feeding of said tape under tension around said forming roll folding over said longitudinal edge and adhesively securing it to said tape along its length.

3. In the tape dispenser of claim 2, said edge folding flange being inclined upwardly and outwardly.

4. In the tape dispenser of claim 1, the mounting of said tape edge folding roll including a stud at one end secured to and projecting at right angles from said support plate overlying said base plate;

said forming roll being loosely journaled upon said stud;

and a snap ring secured upon said stud loosely engaging said forming roll.

5. An edge blending masking tape dispenser comprising an upright roll support plate having a right angular apertured base plate mountable upon a support and having at one end an elevated serrated tape tear off edge;

an upright roll of adhesive coated masking tape journaled and yieldably retained upon said support plate above said base plate;

a tape edge folding and forming die assembly spaced from said tape roll mounted upon said support plate and having a channel of less width than the tape;

the free end of the tape extending to and around said forming die assembly to and over said tear-off edge for longitudinal manual feeding thereof;

said die assembly elevating one longitudinal edge of the tape and folding said edge down onto the tape as it passes around said die assembly, automatically forming downstream of said die assembly a folded down non-stick strip along one edge of said tape;

said die assembly including a tape edge folding roll journaled upon said support plate, supporting the free end of the tape as it passes over and therearound;

an elongated tape edge folding die adjustably mounted upon said support plate and interposed between said tape roll and folding roll, said folding die having an elongated support and along one edge an upright tape guide at its forward end inclined and converging inwardly deflecting and folding upwardly one longitudinal edge of the leading portion of said tape;

the mounting of said folding die upon said support plate including a stud at one end secured to said support plate at right angles thereto;

an apertured stirrup secured to and depending from said folding die intermediate its ends and mounted upon said stud;

and an adjustable fastener upon said stud retainingly engaging said stirrup.

6. In the tape dispenser of claim 5, a yieldable compression spring mounted upon said stud interposed between said stirrup and support plate, adjustment of said fastener and lateral movement of said folding die relative to said support plate adapted to regulate the width of said folded over tape edge with respect to the width of the strip of tape.

* * * * *